US010906773B2

(12) United States Patent
Mustonen

(10) Patent No.: US 10,906,773 B2
(45) Date of Patent: Feb. 2, 2021

(54) REMOTE FAULT CLEARING FOR ELEVATORS, ESCALATORS, AND AUTOMATIC DOORS

(71) Applicant: Kone Corporation, Helsinki (FI)

(72) Inventor: Matti Mustonen, Helsinki (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 15/985,856

(22) Filed: May 22, 2018

(65) Prior Publication Data

US 2018/0362293 A1 Dec. 20, 2018

(30) Foreign Application Priority Data

Jun. 14, 2017 (EP) ..... 17176019

(51) Int. Cl.

| | |
|---|---|
| ***B66B 1/34*** | (2006.01) |
| ***B66B 5/00*** | (2006.01) |
| ***B66B 25/00*** | (2006.01) |
| ***B66B 5/02*** | (2006.01) |

(52) U.S. Cl.

CPC ..... *B66B 1/3461* (2013.01); *B66B 5/0025* (2013.01); *B66B 5/0031* (2013.01); *B66B 5/0087* (2013.01); *B66B 5/027* (2013.01); *B66B 25/00* (2013.01)

(58) Field of Classification Search

CPC ..... B66B 1/3461; B66B 5/027; B66B 5/0025; B66B 25/00; B66B 5/0087; B66B 5/0031

See application file for complete search history.

(56) References Cited

U.S. PATENT DOCUMENTS

| | | | | |
|---|---|---|---|---|
| 7,350,626 | B2 | 4/2008 | Lence et al. | |
| 2001/0011358 | A1* | 8/2001 | Ochiai | G06F 11/0745 714/45 |
| 2007/0261924 | A1 | 11/2007 | Lindberg et al. | |
| 2015/0251875 | A1 | 9/2015 | Lustenberger | |
| 2015/0329322 | A1* | 11/2015 | Osmanbasic | B66B 5/046 187/373 |
| 2016/0012707 | A1* | 1/2016 | McKinley | G08B 25/10 340/679 |

(Continued)

OTHER PUBLICATIONS

Extended European Search Report #17176019 dated Dec. 15, 2017.

*Primary Examiner* — Thomas C Lee
*Assistant Examiner* — Charles Cai
(74) *Attorney, Agent, or Firm* — Harness, Dickey & Pierce, P.L.C.

(57) ABSTRACT

Controlling an apparatus may include detecting a fault in the apparatus, such that a controller of the apparatus exits a normal operation state for controlling the apparatus and enters a faulted state based on the detected fault, operation of the apparatus is stopped based on the controller entering the faulted state, and the detected fault is recorded in a fault memory or a fault recorder of the controller. The controlling may include receiving a remote fault clearing command subsequent to detecting the fault, and clearing the detected fault in response to the remote fault clearing command, such that the controller exits the faulted state and enters the normal operation state, and operation of the apparatus is enabled based on the controller entering the normal operation state. Clearing the detected fault may include deleting the detected fault from the fault memory or fault recorder.

17 Claims, 5 Drawing Sheets

(56) References Cited

U.S. PATENT DOCUMENTS

| | | | | |
|---|---|---|---|---|
| 2016/0071674 | A1* | 3/2016 | Kitora | G03G 15/5004 307/140 |
| 2017/0190548 | A1* | 7/2017 | Nelson | B66B 29/005 |
| 2018/0111794 | A1* | 4/2018 | Lu | B66B 5/027 |
| 2018/0251337 | A1* | 9/2018 | Matsueda | B66B 5/00 |

* cited by examiner

REMOTE FAULT CLEARING FOR ELEVATORS, ESCALATORS, AND AUTOMATIC DOORS

This application claims priority to European Patent Application No. EP171760192 filed on Jun. 14, 2017, the entire contents of which are incorporated herein by reference.

FIELD OF THE INVENTION

The present invention relates to an apparatus, a method and a computer program product for performing a remotely activated recovery operation in an elevator, an escalator and automatic doors (e.g., automatic building doors) in case a fault is present.

RELATED BACKGROUND ART

The following description of background art and examples may include insights, discoveries, understandings or disclosures, or associations, together with disclosures not known to the relevant prior art, to at least some examples of embodiments of the present invention but provided by the invention. Some of such contributions of the invention may be specifically pointed out below, whereas other of such contributions of the invention will be apparent from the related context.

Some examples of the present disclosure relate to elevators. An elevator can stop due to a fault/malfunction between the floors leaving possible passengers trapped inside the car. Some faults require a power-down sequence and/or RDF (rescue drive function) switch activation i.e. an intervention by a service technician.

In more detail, in some cases when the elevator control software (SW) detects a fault situation, the elevator is stopped immediately. If the car is moving between the floors with passengers inside the car they might get trapped in the elevator as the recovery is possible only when the maintenance technician receives a call-out, enters the site and makes the power cycle to the elevator or activates the service mode to restore normal operation of the device.

For example, when a fault/malfunction occurs in an elevator, this fault can be classified and indicated by a fault code. Based on this fault code, recovery measures can be specified. Thus, for example if such a recovery measure includes operations such as "power down" or "Power Off and On" or "Manual Reset by Machine Room Inspection" or "machine room inspection drive" or "inspection drive", a technician receives the call-out, enters the site and either makes the power cycling (i.e. switches supply power off and on) for the elevator or activates the service mode with a RDF switch in order to release potentially trapped users. If the elevator is still faulted, the needed corrective actions are executed to remove the cause of the fault.

Hence, it is necessary that a technician will enter the site and performs a procedure to fix the fault/malfunction. For example, the technician may perform a power cycling (also referred to as "power off-on") by disconnecting the supply power to the control system manually in order to reboot the system or activating a RDF (rescue drive feature) switch at the machine room or the car roof.

A simplified system state machine is shown in FIG. 5. That is, after performing a "power up sequence" state ST51 successfully ("true"), a normal operation ("normal operation mode") state ST52 is entered. If during this state, a fault is detected, a "faulted" state ST53 is entered. The fault may be overcome by activating the RDF switch by a technician, wherein then the system may enter the "normal operation mode" state again. Alternatively, the technician may overcome the fault by performing power cycling. In this case, the system will enter the power up sequence again, and after successfully carrying the power up, the "normal operation mode" state is entered again. Further alternatively, the fault may be overcome by other conditions detected locally, which are handled by the technician manually on site. Also then, the "normal operation mode" state may be entered again.

Thus, the above procedure involves costs and also time, during which the passengers are trapped inside the car. Similar disadvantages may also occur in case of escalators or automatic doors.

SUMMARY OF THE INVENTION

Thus, it is an object of the present invention to overcome these disadvantages and to provide a method and a device for controlling an elevator, escalator or automatic doors by which costs and time required for fixing a fault/malfunction of the elevator, escalator or automatic doors can be reduced.

According to a first aspect of the present invention, a method for controlling an apparatus being an elevator, an escalator or automatic doors is provided, the method comprising detecting a fault in the apparatus, receiving a remote fault clearing command, clearing one or more faults and exiting a fault state of a controller of the apparatus related to the detected fault, and entering an operation mode for controlling the apparatus.

According to a second aspect of the present invention, a control device for controlling an apparatus being an elevator, an escalator or automatic doors is provided, which comprises a controller, wherein the controller is configured to detect a fault in the apparatus, receive a remote fault clearing command, clear one or more faults and exit a fault state of a controller of the apparatus related to the detected fault, and enter an operation mode for controlling the apparatus.

The first and second aspects may be modified as follows:

It may be determined, after receiving the remote fault clearing command, whether the detected fault allows a remote fault clearing of the controller, and the one or more faults of the controller may be cleared only when the detected fault allows remote fault clearing.

Faults of the apparatus may be classified in different kinds of faults, and it may be determined based on the kind of the detected fault whether the detected fault allows a remote fault clearing.

The remote fault clearing command may be received from a service center via a connectivity/remote monitoring device.

The remote fault clearing command may be initiated by a person or by a software algorithm.

Moreover, clearing of the one or more faults may be performed by activating a rescue drive function (RDF) switch provided at the controller.

Clearing of one or more faults may comprise clearing all faults or clearing faults which prevent returning the apparatus to a predetermined operation mode.

According to a third aspect of the present invention, a system is provided which comprises a control device according to the second aspects and/or any one of the modifications thereof, and a service center configured to send the remote fault clearing command to the control device via a connectivity/remote monitoring device.

According to a fourth aspect of the present invention, a computer program product is provided which comprises code means for performing a method according to the above first aspects and/or any of its modifications described above when run on a processing means or module. The computer program product may be embodied on a computer-readable medium, and/or the computer program product may be directly loadable into the internal memory of the computer and/or transmittable via a network by means of at least one of upload, download and push procedures.

BRIEF DESCRIPTION OF THE DRAWINGS

These and other objects, features, details and advantages will become more fully apparent from the following detailed description of embodiments of the present invention which is to be taken in conjunction with the appended drawings, in which.

DETAILED DESCRIPTION OF EMBODIMENTS

In the following, description will be made to embodiments of the present invention. It is to be understood, however, that the description is given by way of example only, and that the described embodiments are by no means to be understood as limiting the present invention thereto.

It is to be noted that the following examples and embodiments are to be understood only as illustrative examples. Although the specification may refer to "an", "one", or "some" example(s) or embodiment(s) in several locations, this does not necessarily mean that each such reference is related to the same example(s) or embodiment(s), or that the feature only applies to a single example or embodiment. Single features of different embodiments may also be combined to provide other embodiments. Furthermore, terms like "comprising" and "including" should be understood as not limiting the described embodiments to consist of only those features that have been mentioned; such examples and embodiments may also contain features, structures, units, modules etc. that have not been specifically mentioned.

The general elements and functions of described elevator systems, details of which also depend on the actual type of elevator system, are known to those skilled in the art, so that a detailed description thereof is omitted herein. However, it is to be noted that several additional devices and functions besides those described below in further detail may be employed in an elevator system.

Figure 1:
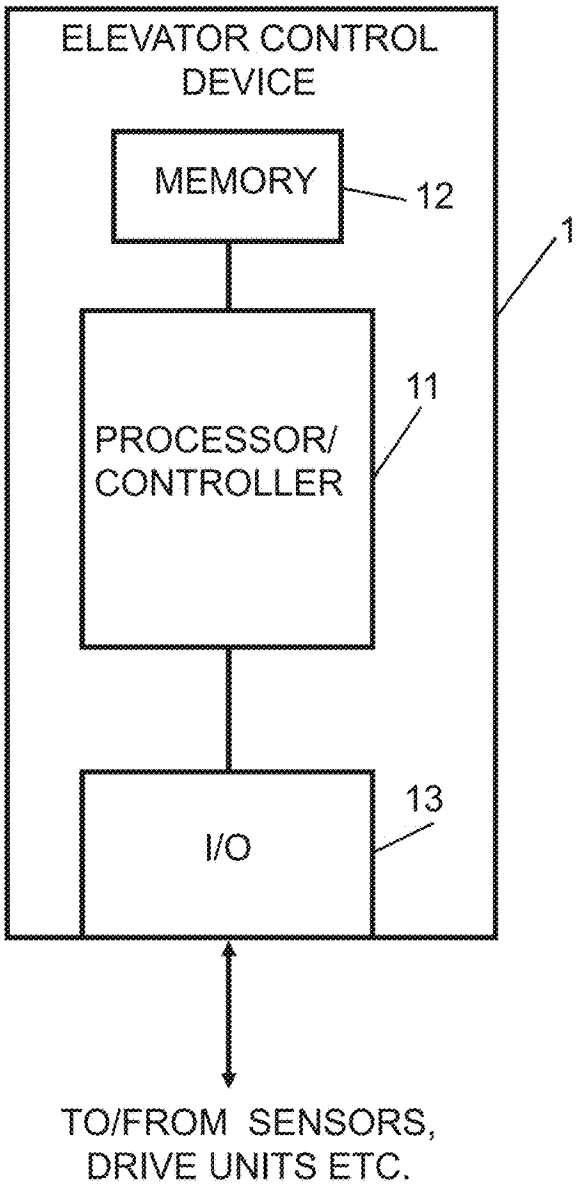
FIG. 1 shows an elevator control apparatus according to some embodiments of the present invention.

FIG. 1 shows a schematic diagram illustrating a configuration of an elevator control device 1 where some examples of embodiments are implementable. In particular, the elevator control device comprises a processor or controller 11. The elevator control device may further comprise a memory 12 in which programs to be carried out and data required are stored, and input/output units 13, via which control signals may be transmitted to other control units, elevator drives etc., and/or signals from sensors or other control units etc. may be received.

Figure 2:
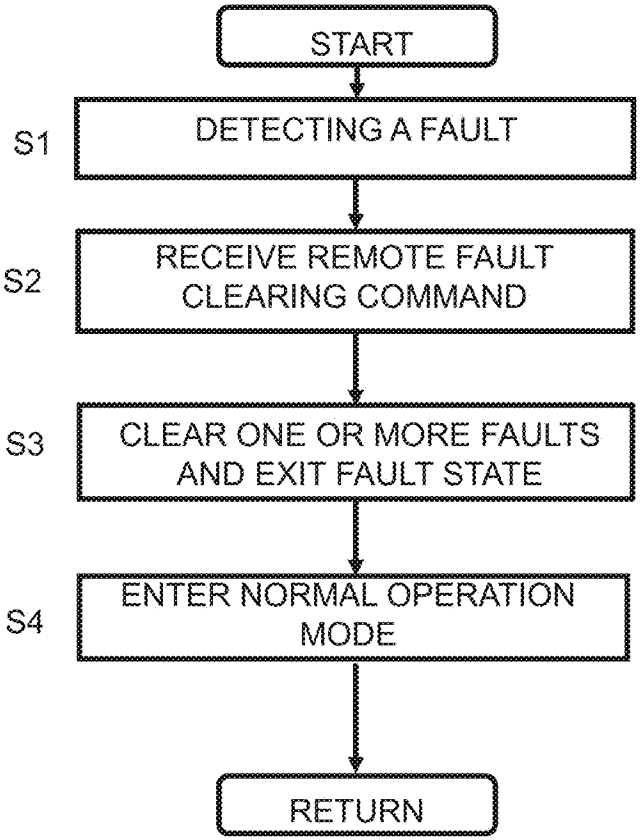
FIG. 2 shows a method for controlling an elevator according to an embodiment of the present invention.

The controller 11 shown in FIG. 1 may be configured to carry out a method as illustrated in FIG. 2.

In step S1, a fault is detected. For example, in response to such a detection, the fault may be reported to a remote service center. In step S2, a remote fault clearing command may be received, for example from the remote service center. Then, in step S3, one or more faults of a control unit of the elevator are cleared and a fault state of the control unit is exited, and in step S4, the operation mode for controlling the elevator (i.e., the normal operation of the elevator) is entered.

Thus, a remote fault clearing command can be received and one or more faults of the control unit of the elevator can be cleared and the fault state can be exited, and then the normal operation mode (e.g., the "normal operation mode" state shown in FIG. 5) may be entered again. The control unit of which the one or more faults are to be cleared may be the controller 11 shown in FIG. 1, but may also be another control unit which is related to the detected fault. For example, when the fault is caused by a separate motor controller, then a fault clearing of only this controller may be performed.

Hence, according to embodiments of the present invention, a remote fault clearing is performed, so that a fault/malfunction of an apparatus such as an elevator, escalator or automatic doors can be quickly fixed. Hence, costs and time required for fixing a fault/malfunction can be reduced.

The term "remote fault clearing" as used herein means that a command is remotely sent to an apparatus and that the apparatus, after receiving this command, clears faults (which are recorded in a fault memory or fault recorder, for example) and exits the fault state. Fault clearing means that one or more faults which are stored, e.g., in a fault memory or fault recorder of the controller are cleared. For example, all faults may be cleared.

Moreover, for example at least those faults may be cleared which prevent returning the apparatus to a predetermined operation mode. The predetermined operation mode may be the normal operation mode described above in connection with step S4. In other words, the predetermined operation mode or the normal operation mode may be a normal service mode. The normal service mode is an operating mode in which the apparatus is, when it is started and reached a full functional state. That is, the normal service mode may be an operation mode in which passengers can be transported (as in case of an elevator or an escalator) or in which automatic doors can be opened and closed automatically. Alternatively stated, the predetermined operation mode may be the operation mode in which the apparatus was when the fault turned the controller into a fault mode.

Examples for a fault that turns the controller to the fault state and that can be tried to solve with fault clearing comprise low voltage or other disturbance in an electric power supplying grid. However, the invention is not limited to these examples, and various other kinds of faults are possible.

Moreover, when a fault is detected in the apparatus, this fault may be stored/recorded in the in the controller (e.g., in the fault memory or fault recorder). Hence, in this case fault clearing may refer to deleting this particular fault which has been stored/recorded in the controller.

Moreover, according to some embodiments, clearing of the faults can be effected by a remote activation of an RDF. Activation of the RDF clears one or more (or all) fault signals, i.e. it does a "fault clearing" operation. That is, clearing of one or more (or all) faults may be performed by activating a rescue drive function (RDF) switch provided at the controller. For example, when the remote fault clearing command is received by the elevator control device 1 shown in FIG. 1, then the processor 11 may activate the RDF switch. In this way, a remote RDF activation is achieved.

Figure 3:
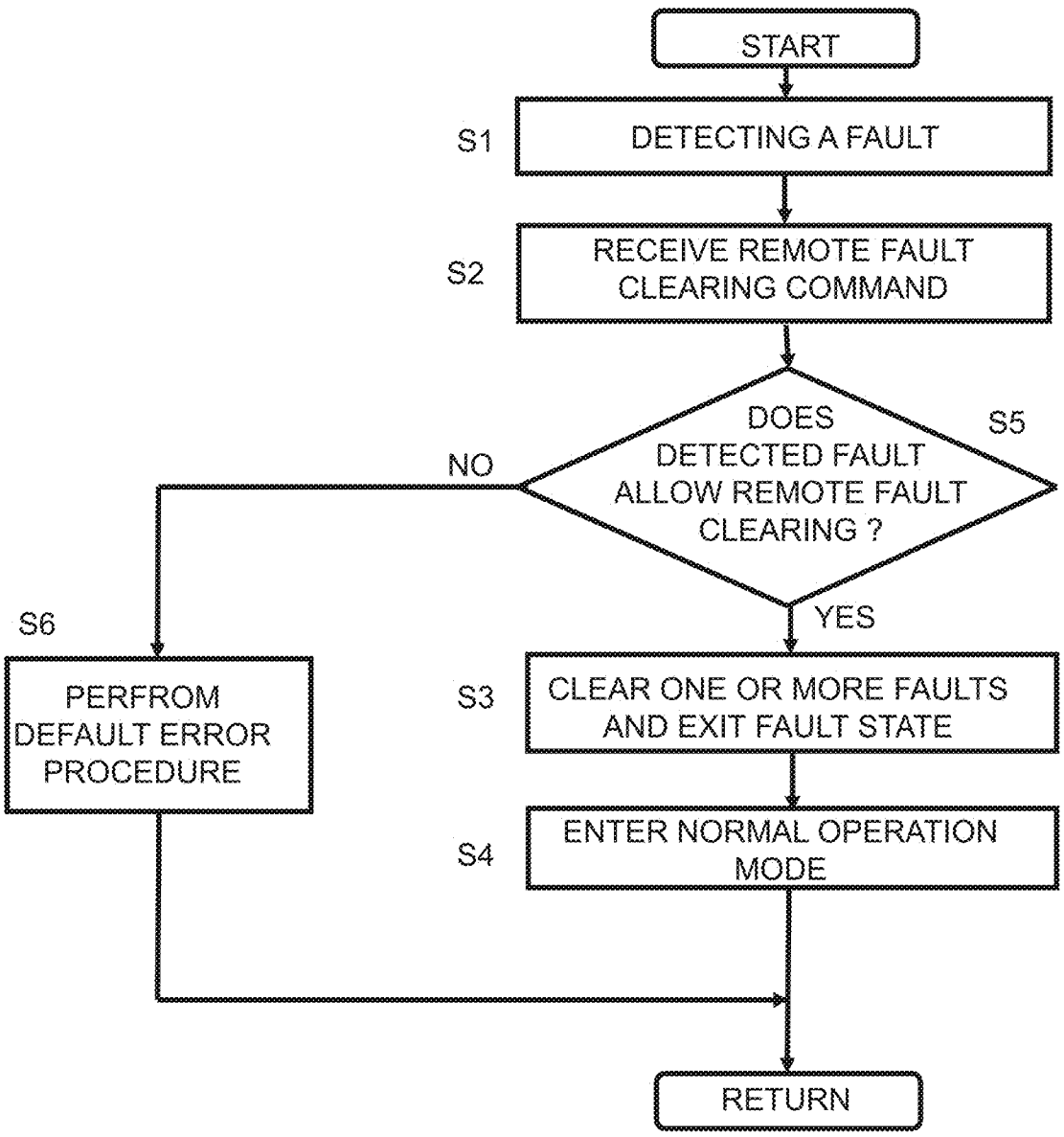
FIG. 3 shows a more detail method for controlling an elevator according to an embodiment of the present invention.

FIG. 3 shows a modified method, in which it is considered that, depending on the kind of fault detected, a remote fault clearing command may not be allowed.

In particular, the method according to FIG. 3 comprises additionally steps S5 and S6, which are described in the following.

In step S5, which is carried out after receiving the remote fault clearing command in step S2, it is checked whether the detected fault allows a remote fault clearing. For example, there may be application standards which prohibit a remote fault clearing for certain kind of faults and require a manual involvement of a technician. If this is not the case (YES in step S5), then steps S3 and S4 follow as described above in connection with FIG. 2.

However, when the detected fault does not allow a remote fault clearing (NO in step S5), then a default error procedure is carried out. For example, the elevator may be taken out of service, and a technician has to enter the site and has to manually fix the fault/malfunction of the elevator.

For deciding whether the fault allows a remote fault clearing, the faults may classified in different kinds of faults (and optionally indicated by fault codes), and it may be determined based on the kind of the detected fault whether the detected fault allows a remote fault clearing.

Furthermore, a system according to some embodiments of the present invention comprises a control device as shown in FIG. 1 which is configured to carry out the method shown in FIG. 2 or FIG. 2, and a service center configured to send the remote fault clearing command to the control device via a connectivity/remote monitoring device.

Hence, according to embodiments of the present invention, a fault recovery method is applied in which a remote fault clearing over a communication interface is performed. Effectively, the remote fault clearing command does not make the power cycle reset, but commands the controller to clear one or more faults (fault signals) and to enter the normal operation mode. This remote fault clearing command may come from a service center via connectivity/remote monitoring device and it would be initiated by a person or a software algorithm.

Therefore, the risk of passengers becoming trapped in the elevator can be greatly reduced and, also, the number of call-outs for a technician can be reduced.

In the following, some more detailed embodiments of the present invention are described.

As mentioned above, according to embodiments of the present invention, a dedicated "fault clearing command" is used to recover from a fault situation.

Figure 4:
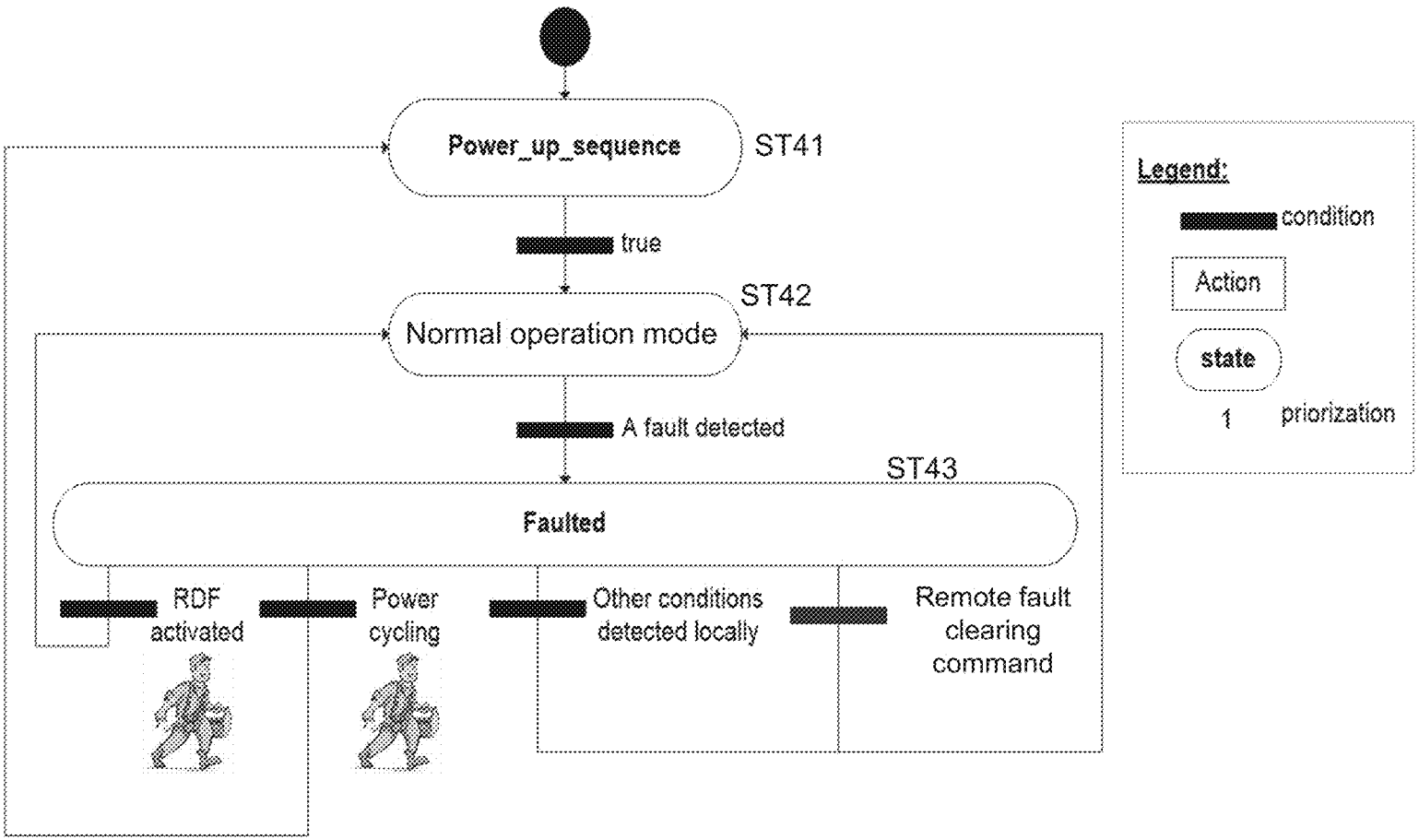
FIG. 4 shows a state diagram illustrating different states in a method for controlling an elevator according to an embodiment of the present invention.
Figure 5:
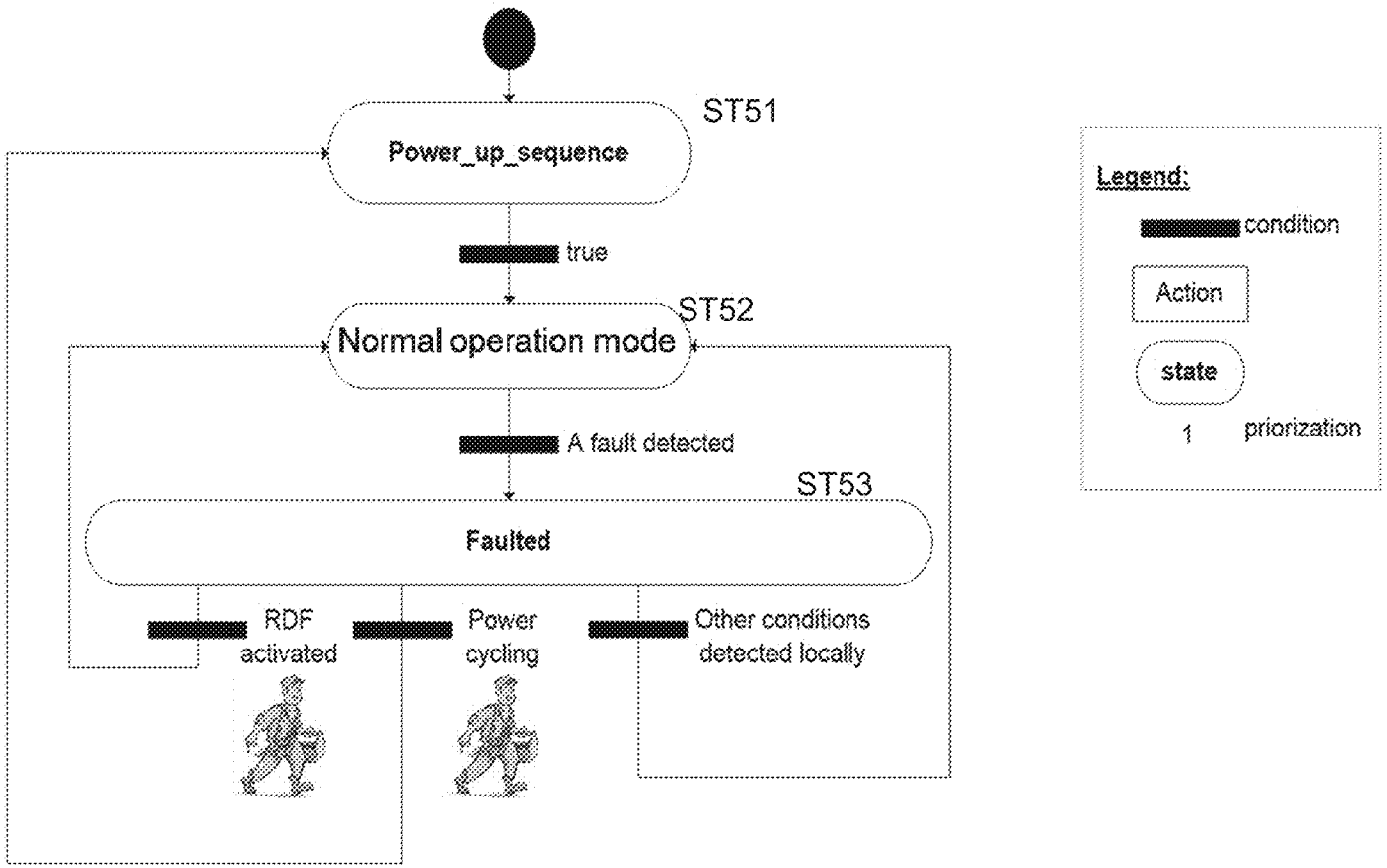
FIG. 5 illustrates a simplified system state machine for fixing a fault/malfunction in an elevator according to the prior art.

According to embodiments of the present invention, a simplified state machine would be as shown in FIG. 4. This state machine is similar to that as shown in FIG. 5, with the exception for the additional functionality in connection with the remote fault clearing command, as will be described in the following.

As described in connection with FIG. 5, after performing a "power up sequence" state ST41 successfully ("true"), a normal operation ("normal operation mode") state ST42 is entered. If during this state, a fault is detected, a "faulted" state ST43 is entered. The fault may be overcome by activating the RDF switch located at the elevator by a technician, wherein then the system may enter the "normal operation mode" state again. Alternatively, the technician may overcome the fault by performing power cycling. In this case, the system will enter the power up sequence again, and after successfully carrying the power up, the "normal operation mode" state is entered again. Further alternatively, the fault may be overcome by other conditions detected locally, which are handled by the technician manually on site. Also then, the "normal operation mode" state may be entered again.

However, according to the present embodiment, the "faulted" state ST43 may be overcome by using the remote fault clearing command. This remote fault clearing command does not lead to the power up sequence state ST41, but to the "normal operation mode" state S42, so that the normal operation mode is entered again.

That is, the remote fault clearing command would not make the "power-on-reset" but would enter to normal operation mode ("normal operation mode"). The other existing reset functionalities (RDF, power-cycling) would remain as needed by a technician without the remote connection to the device.

This remote fault clearing command would come from a service center via connectivity/remote monitoring device and it would be initiated by a person or a software algorithm.

Furthermore, in some fault situations the existing standards and codes require that there must be "a skilled technician at the site". In such a case the control system must not accept the remote fault clearing command and as a result the system would remain in "Faulted" state waiting for manual intervention, as described above in connection with FIG. 3.

Thus, according to embodiments of the present invention, a long trapment of passengers inside a car and a call-out and technician's site visit can be avoided since it is possible to carry out a remote fault clearing.

Embodiments of the present invention are not limited to the details of the embodiments as described above, and various modifications are possible.

For example, the elevator control device 1 and in particular the controller 11 shown in FIG. 1 may be provided separately from a control device carrying out the overall control of the elevator, or may be part of a plurality of control units commonly carrying out the control of the elevator. Alternatively, the controller 1 may be part of a main control device carrying out the overall control of the elevator.

Furthermore, in FIG. 4 a detailed functionality of the elevator control was shown. However, embodiments of the present invention are not limited to such details. In particular, the flow can be arbitrarily modified. For example, also further procedures to overcome a fault state may be added, or some of the procedures shown (apart from the remote fault clearing command) may be omitted.

According to some embodiments as described above, a control of an elevator is described. However, embodiments of the present invention are not limited to this. For example, the control may also be applied to an escalator or automatic doors. In this case, also the advantage can be achieved that it is not always required that a technician enters the site. Moreover, the time for taking the escalator or automatic doors into service again can be shortened.

It is to be understood that any of the above modifications can be applied singly or in combination to the respective aspects and/or embodiments to which they refer, unless they are explicitly stated as excluding alternatives.

Furthermore, elevator system elements, in particular operation elements, control elements (e.g., the elevator control device 1) or detection elements, as well as corresponding functions as described herein, and other elements, functions or applications may be implemented by software, e.g. by a computer program product for a computer, and/or by hardware. For executing their respective functions, correspondingly used devices, elements or functions may include several means, modules, units, components, etc. (not shown) which are required for control, processing and/or communication/signaling functionality. Such means, modules, units and components may include, for example, one or more processors or processor units including one or more processing portions for executing instructions and/or programs and/or for processing data, storage or memory units or means for storing instructions, programs and/or data, for serving as a work area of the processor or processing portion and the like (e.g. ROM, RAM, EEPROM, and the like), input or interface means for inputting data and instructions by software (e.g. floppy disc, CD-ROM, EEPROM, and the like), a user interface for providing monitor and manipulation possibilities to a user (e.g. a screen, a keyboard and the like), other interface or means for establishing links and/or connections under the control of the processor unit or portion (e.g. wired and wireless interface means etc.) and the like. It is to be noted that in the present specification processing portions should not be only considered to represent physical portions of one or more processors, but may also be considered as a logical division of the referred processing tasks performed by one or more processors.

For the purpose of the present invention as described herein above, it should be noted that

- embodiments suitable to be implemented as software code or portions of it and being run using a processor or processing function are software code independent and can be specified using any known or future developed programming language, such as a high-level programming language, such as objective-C, C, C++, C#, Java, Python, Javascript, other scripting languages etc., or a low-level programming language, such as a machine language, or an assembler.
- implementation of embodiments is hardware independent and may be implemented using any known or future developed hardware technology or any hybrids of these, such as a microprocessor or CPU (Central Processing Unit), MOS (Metal Oxide Semiconductor), CMOS (Complementary MOS), BiMOS (Bipolar MOS), BiCMOS (Bipolar CMOS), ECL (Emitter Coupled Logic), and/or TTL (Transistor-Transistor Logic).
- embodiments may be implemented as individual devices, apparatuses, units, means or functions, or in a distributed fashion, for example, one or more processors or processing functions may be used or shared in the processing, or one or more processing sections or processing portions may be used and shared in the processing, wherein one physical processor or more than one physical processor may be used for implementing one or more processing portions dedicated to specific processing as described,
- a device may be implemented by a semiconductor chip, a chipset, or a (hardware) module including such chip or chipset;
- embodiments may also be implemented as any combination of hardware and software, such as ASIC (Application Specific IC (Integrated Circuit)) components, FPGA (Field-programmable Gate Arrays) or CPLD (Complex Programmable Logic Device) components or DSP (Digital Signal Processor) components.
- embodiments may also be implemented as computer program products, including a computer usable medium having a computer readable program code embodied therein, the computer readable program code adapted to execute a process as described in embodiments, wherein the computer usable medium may be a non-transitory medium.

Although the present invention has been described herein before with reference to particular embodiments thereof, the present invention is not limited thereto and various modifications can be made thereto.

The invention claimed is:

1. A method for controlling an apparatus, the apparatus being an elevator, an escalator or automatic doors, the method comprising:

- detecting a fault in the apparatus, such that
  - a controller of the apparatus exits a normal operation state for controlling the apparatus and enters a faulted state based on the detected fault,
  - operation of the apparatus is stopped based on the controller entering the faulted state, and
  - the detected fault is recorded in a fault memory or a fault recorder of the controller;
- receiving a remote fault clearing command subsequent to detecting the fault; and
- clearing, in response to receiving the remote fault clearing command and in response to a determination that clearing of the detected fault based on remote fault clearing of the controller is permitted, the detected fault by activating a rescue drive function (RDF) switch provided at the controller in response to the remote fault clearing command and without performing a power cycle reset and without manual RDF switch activation, such that
  - the controller activates the RDF switch to exit the faulted state and enter the normal operation state without power for the apparatus being cycled and without the controller entering a service mode based on manual RDF activation, and
  - operation of the apparatus is enabled based on the controller entering the normal operation state,
- wherein clearing the detected fault includes deleting a recording of the detected fault from the fault memory or the fault recorder of the controller,
- wherein the activating the RDF switch is performed in response to the remote fault clearing command being received, and the activating the RDF switch causes the clearing the detected fault, such that the recording of the detected fault is deleted from the fault memory or the fault recorder of the controller.

2. The method according to claim 1, wherein

- the determination that the clearing of the detected fault based on remote fault clearing of the controller is permitted includes a determination that
  - the detected fault is associated with a particular fault type, and
  - clearing of faults associated with the particular fault type based on remote fault clearing of the controller is permitted.

3. The method according to claim 1, wherein the remote fault clearing command is received from a service center via a connectivity/remote monitoring device.

4. The method according to claim 3, wherein the remote fault clearing command is initiated by a person or by a software algorithm.

5. The method according to claim 1, wherein the clearing the detected fault includes clearing all faults recorded in the fault memory or the fault recorder of the controller, or clearing a selection of faults, recorded in the fault memory or the fault recorder of the controller, which prevent the controller from exiting the faulted state and entering the normal operation state.

6. A control device, comprising:

a memory storing a program of instructions;

a rescue drive function (RDF) switch; and a processor configured to execute the program of instructions to control operation of an apparatus, the apparatus being an elevator, an escalator or automatic doors detect a fault in the apparatus, such that a controller of the apparatus exits a normal operation state for controlling the apparatus and enters a faulted state based on the detected fault, operation of the apparatus is stopped based on the controller entering the faulted state, and the detected fault is recorded in a fault memory or a fault recorder of the controller, receive a remote fault clearing command subsequent to detecting the fault, and clear, in response to receiving the remote fault clearing command and in response to a determination that clearing of the detected fault based on remote fault clearing of the controller is permitted, the detected fault by activating the RDF switch in response to the remote fault clearing command and without performing a power cycle reset and without manual RDF switch activation, such that the controller activates the RDF switch to exit the faulted state and enter the normal operation state without power for the apparatus being cycled and without the controller entering a service mode based on manual RDF activation, and operation of the apparatus is enabled based on the controller entering the normal operation state, wherein clearing the detected fault includes deleting a recording of the detected fault from the fault memory or the fault recorder of the controller, wherein the activating the RDF switch is performed in response to the remote fault clearing command being received, and the activating the RDF switch causes the clearing the detected fault, such that the recording of the detected fault is deleted from the fault memory or the fault recorder of the controller.

7. The control device according to claim 6, wherein the determination that the clearing of the detected fault based on remote fault clearing of the controller is permitted includes a determination that the detected fault is associated with a particular fault type, and clearing of faults associated with the particular fault type based on remote fault clearing of the controller is permitted.

8. The control device according to claim 6, wherein the clearing the detected fault includes clearing a selection of faults, recorded in the fault memory or the fault recorder of the controller, which prevent the controller from exiting the faulted state and entering the normal operation state.

9. A system comprising:

the control device according to claim 6; and a service center configured to send the remote fault clearing command to the control device via a remote monitoring device.

10. The system according to claim 9, wherein the remote fault clearing command is initiated by a person or by a software algorithm.

11. A non-transitory computer readable storage medium storing a program of instructions that, when executed by a processor, causes the processor to perform a method for controlling an apparatus, the apparatus being an elevator, an escalator or automatic doors, the method comprising:

detecting a fault in the apparatus, such that a controller of the apparatus exits a normal operation state for controlling the apparatus and enters a faulted state based on the detected fault, operation of the apparatus is stopped based on the controller entering the faulted state, and the detected fault is recorded in a fault memory or a fault recorder of the controller;

receiving a remote fault clearing command subsequent to detecting the fault; and clearing, in response to receiving the remote fault clearing command and in response to a determination that clearing of the detected fault based on remote fault clearing of the controller is permitted, the detected fault by activating a rescue drive function (RDF) switch provided at the controller in response to the remote fault clearing command and without performing a power cycle reset and without manual RDF switch activation, such that the controller activates the RDF switch to exit the faulted state and enter the normal operation state without power for the apparatus being cycled and without the controller entering a service mode based on the manual RDF switch activation, and operation of the apparatus is enabled based on the controller entering the normal operation state, wherein clearing the detected fault includes deleting a recording of the detected fault from the fault memory or the fault recorder of the controller, wherein the activating the RDF switch is performed in response to the remote fault clearing command being received, and the activating the RDF switch causes the clearing the detected fault, such that the recording of the detected fault is deleted from the fault memory or the fault recorder of the controller.

12. The non-transitory computer readable storage medium according to claim 11, wherein the determination that the clearing of the detected fault based on remote fault clearing of the controller is permitted includes a determination that the detected fault is associated with a particular fault type, and clearing of faults associated with the particular fault type based on remote fault clearing of the controller is permitted.

13. The non-transitory computer readable storage medium according to claim 11, wherein the remote fault clearing command is received from a service center via a connectivity/remote monitoring device.

14. The non-transitory computer readable storage medium according to claim 11, wherein the clearing the detected fault includes clearing all faults recorded in the fault memory or the fault recorder of the controller, or clearing a selection of faults, recorded in the fault memory or the fault recorder of the controller, which prevent the controller from exiting the faulted state and entering the normal operation state.

15. The method according to claim 2, wherein the particular fault type is a disturbance in an electric power supplying grid.

16. The control device according to claim 7, wherein the particular fault type is a disturbance in an electric power supplying grid.

17. The non-transitory computer readable storage medium according to claim 12, wherein the particular fault type is a disturbance in an electric power supplying grid.

* * * * *